US011361955B2

(12) United States Patent
Murata

(10) Patent No.: US 11,361,955 B2
(45) Date of Patent: Jun. 14, 2022

(54) PROBE ELECTROSPRAY IONIZATION MASS SPECTROMETER

(71) Applicant: SHIMADZU CORPORATION, Kyoto (JP)

(72) Inventor: Tasuku Murata, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/963,860

(22) PCT Filed: Jan. 26, 2018

(86) PCT No.: PCT/JP2018/002500

§ 371 (c)(1),
(2) Date: Jul. 22, 2020

(87) PCT Pub. No.: WO2019/146078

PCT Pub. Date: Aug. 1, 2019

(65) Prior Publication Data

US 2021/0043438 A1 Feb. 11, 2021

(51) Int. Cl.
*H01J 49/16* (2006.01)
*H01J 49/00* (2006.01)

(52) U.S. Cl.
CPC ..... *H01J 49/165* (2013.01); *H01J 49/004* (2013.01)

(58) Field of Classification Search
CPC .... H01J 49/165; H01J 49/004; H01J 49/0045; H01J 49/40; H01J 49/42
See application file for complete search history.

(56) References Cited

U.S. PATENT DOCUMENTS 8,710,436 B2 * 4/2014 Otsuka ..... H01J 49/0031 250/288
9,064,680 B2 * 6/2015 Van Berkel ..... G01Q 60/38
(Continued)

FOREIGN PATENT DOCUMENTS

JP 2014-044110 A 3/2014
JP 2015-32463 A 2/2015
(Continued)

OTHER PUBLICATIONS

Yumi Hayashi et al., "Construction of in vivo real-time monitoring method by PESI/MS/MS", Shimadzu Review, Sep. 2017, vol. 74, Nos. 1 and 2.

(Continued)

*Primary Examiner* — Wyatt A Stoffa
(74) *Attorney, Agent, or Firm* — Sughrue Mion, PLLC

(57) ABSTRACT

A synchronization condition setting processing unit receives a user's selection regarding an MRM transition for which the timing of starting voltage application to a probe is to be synchronized with the timing of starting analysis. A mass spectrometry control unit controls a mass spectrometric unit to repeat a cycle of executing MRM measurement of a plurality of preset MRM transitions, while an ionization control unit controls a PESI ion source to alternately repeat an up-and-down movement of the probe and high voltage application to the probe, and at that time, a synchronization control unit controls control operations of a mass spectrometry control unit and an ionization control unit such that timings of start of the MRM measurement for the MRM transition selected by the user and start of application of voltage to the probe match.

11 Claims, 5 Drawing Sheets

(56) References Cited

U.S. PATENT DOCUMENTS

| | | | | |
|---|---|---|---|---|
| 9,269,557 | B2 * | 2/2016 | Otsuka | H01J 49/165 |
| 9,390,901 | B2 * | 7/2016 | Kertesz | H01J 49/142 |
| 9,875,884 | B2 * | 1/2018 | Lopez-Avila | H05H 1/46 |
| 11,219,393 | B2 * | 1/2022 | Taghioskoui | H01J 49/0004 |
| 2010/0311176 | A1 * | 12/2010 | Williamson | G01N 33/6848 436/86 |
| 2015/0034817 | A1 * | 2/2015 | Otsuka | H01J 49/0459 250/288 |
| 2015/0034821 | A1 | 2/2015 | Kyogaku et al. | |
| 2015/0155148 | A1 | 6/2015 | Kyogaku et al. | |
| 2015/0311055 | A1 | 10/2015 | Otsuka et al. | |
| 2017/0236699 | A1 | 8/2017 | Ueda et al. | |
| 2017/0352529 | A1 * | 12/2017 | Bailey | H01J 49/0045 |
| 2019/0079050 | A1 | 3/2019 | Zaitsu et al. | |

FOREIGN PATENT DOCUMENTS

| | | | |
|---|---|---|---|
| JP | 2015-46381 | A | 3/2015 |
| WO | 2016/027319 | A1 | 2/2016 |
| WO | 2017/154240 | A1 | 9/2017 |

OTHER PUBLICATIONS

Written Opinion of PCT/JP2018/002500 dated Apr. 17, 2018 [PCT/ISA/237].

Yumi Hayashi et al., "Intact metabolite profiling of mouse brain by probe electrospray ionization/triple quadrupole tandem mass spectrometry (PESI/MS/MS) and its potential use for local distribution analysis of the brain", Analytica Chimica Acta, vol. 983, pp. 160-165, XP085156316, 2017 (6 pages total).

Extended European Search Report dated Jan. 12, 2021 from the European Patent Office in EP application No. 18902477.1.

Office Action dated May 11, 2021 issued by the Japanese Patent Office in Japanese Application No. 2019-567788.

* cited by examiner

PROBE ELECTROSPRAY IONIZATION MASS SPECTROMETER

CROSS REFERENCE TO RELATED APPLICATIONS

This application is a National Stage of International Application No. PCT/JP2018/002500 filed on Jan. 26, 2018, the disclosure of which is incorporated herein in its entirety by reference.

TECHNICAL FIELD

The present invention relates to a mass spectrometer equipped with an ion source by a probe electrospray ionization (PESI) method (hereinafter referred to as "PESI ion source").

BACKGROUND ART

As ionization methods for ionizing components in a sample which is the object of measurement in a mass spectrometer, various methods have conventionally been proposed and put to practical use. As an ionization method in which ionization is performed in an ambient pressure atmosphere, the electrospray ionization (ESI) method is well known, and one ionization method using this ESI that has gained attention in recent years is the PESI method.

As disclosed in Patent Literatures 1 and 2, for example, the PESI ion source includes a conductive probe with a tip diameter of about several hundred nanometers; a displacement unit which moves at least one of either the probe or the sample so as to cause the sample to be adhered to the tip of the probe; and a high voltage generation unit which applies a high voltage of kV order to the probe in a state where the sample is adhered to the tip of the probe. During measurement, at least one of the probe and the sample is moved by the displacement unit, causing the tip of the probe to contact or penetrate slightly into the sample, and causing a small amount of sample to be adhered to the probe tip surface. Then, the probe is detached from the sample by the displacement unit, and a high voltage is applied to the probe from the high voltage generation unit. Thereupon, a strong electric field acts on the sample adhered to the probe tip, inducing an electrospray phenomenon and whereby component molecules in the sample are detached from the probe and ionized.

With a mass spectrometer using a PESI ion source (hereinafter sometimes referred to as "PESI mass spectrometer"), a troublesome sample pretreatment can be omitted and a liquid sample can be used for analysis almost as it is, enabling easy and quick analysis. Further, it is also possible to observe the temporal change in the amount of a specific component in a living tissue of, for example, a living experimental animal in real time.

When performing quantitative analysis of known components using the PESI mass spectrometer, similar to a liquid chromatograph mass spectrometer and a gas chromatograph mass spectrometer, a SIM (selective ion monitoring) measurement targeting a mass-to-charge ratio corresponding to a target component or an MRM (multiple reaction monitoring) measurement targeting an MRM transition corresponding to a target component is performed. When performing quantitative analysis of a plurality of components, a chromatogram showing a temporal change in ionic strength for each component is created by repeating cycles of sequentially performing the SIM measurement or the MRM measurement corresponding to the plurality of components, and each component is quantified based on the chromatogram.

At this time, generally, in the PESI ion source, the probe is periodically moved up and down, and the collection of the sample at the tip of the probe and the ionization of the components in the collected sample by applying the voltage to the probe are repeatedly executed. That is, in the PESI ion source, as shown in FIG. 5, the PESI cycle including the sample collecting operation and the ionization operation is repeated at a predetermined frequency. Since almost no ions are generated during this sample collecting operation, the generation of ions by the PESI ion source is performed intermittently.

When a high voltage is applied to the probe, ions derived from the components in the sample adhered to the probe are generated. Since the amount of sample collected by the probe is small, the rate of generated ions rapidly decreases within a relatively short time from the start of high voltage application. FIG. 6 is a schematic diagram showing an example of changes in ionic strength with lapse of time from the start of application of high voltage to the probe with the sample adhered. In this example, a high ionic strength is exhibited in the period of about 100 msec at the beginning of voltage application. Then, the ionic strength is rapidly attenuated, and when about 300 to 400 msec elapses from the start of voltage application, the ionic strength becomes substantially zero.

As described above, with the PESI ion source, the ions derived from the components in the sample are not generated continuously but intermittently, and the amount of the ions during the period of ion generation also largely decreases with lapse of time. Therefore, when the cycle including a plurality of SIM measurements or MRM measurements is repeated in a mass spectrometric unit as described above, no data can be obtained in the SIM measurement or MRM measurement targeting a specific component or no data with sufficient ionic strength can be obtained in the SIM measurement or MRM measurement targeting a specific component. In such a case, an accurate chromatogram for the ions derived from the specific component cannot be created, and the proper quantitative measurement will be greatly impaired.

Non Patent Literature 1 describes appropriately setting the motion cycle of the probe in the PESI ion source such that the loop time of the MRM transition (the required time of the cycle for executing the MRM measurement once for each of a plurality of MRM transitions) is synchronized with the motion cycle of the probe. However, with such a method, there is a problem that the MRM transitions that can be analyzed with high sensitivity among the plurality of MRM transitions are determined according to the order of MRM measurement, and the user cannot freely select the ion species to be analyzed with high sensitivity. Further, even when all of the plurality of ion species are to be analyzed with substantially the same sensitivity, actually with high sensitivity on average, it is inevitable that the sensitivity varies from ion species to ion species.

When the loop time of MRM measurement is sufficiently shorter than the duration of ion generation by the PESI ion source, of course, the second problem above is relatively unlikely to occur. However, when the dwell time, which is the acquisition time for target ionic strength data, is increased in order to enhance the sensitivity, the loop time also increases. In that case, the influence of a decrease in the amount of ions with lapse of time becomes relatively large, and it is difficult to make the sensitivities of the ion species even.

CITATION LIST

Patent Literature

Patent Literature 1: JP 2014-44110 A

Patent Literature 2: WO 2016/027319 A

Non Patent Literature

Non Patent Literature 1: Yumi Hayashi and 5 others, "Construction of in vivo real-time monitoring method by PESI/MS/MS", Shimadzu Review, Vol. 74, Nos. 1 and 2, published on Sep. 20, 2017.

SUMMARY OF INVENTION

Technical Problem

In view of the above problems, it is an object of the present invention to provide a PESI mass spectrometer capable of, when the SIM measurement or MRM measurement is performed on a plurality of ion species, analyzing ion species desired by the user with high sensitivity or analyzing all ion species with substantially the same sensitivity.

Solution to Problem

In response to the above problems, the present invention is directed to a probe electrospray ionization mass spectrometer including an ion source including a probe having conductivity, a displacement unit configured to move at least one of the probe and a sample to adhere the sample to a tip of the probe, and a high voltage generation unit configured to apply a high voltage to the probe to ionize a component in the sample adhered to the probe, and a mass spectrometric unit configured to perform mass spectrometry on an ion generated by the ion source or an ion derived from the ion, the probe electrospray ionization mass spectrometer including:

a) an ionization control unit configured to control the displacement unit and the high voltage generation unit to repeat a sample collecting operation of moving the probe or the sample by the displacement unit to adhere the sample to the tip of the probe and then detaching the tip of the probe from the sample and an ionization operation of applying a high voltage to the probe by the high voltage generation unit to ionize a sample component;

b) a mass spectrometry control unit configured to control the mass spectrometric unit to repeat a cycle of sequentially executing mass spectrometry targeting a plurality of preset ion species; and c) a synchronization control unit configured to integrally control a control operation of the ionization control unit and/or a control operation of the mass spectrometry control unit such that a timing of executing mass spectrometry targeting an ion species preset by a user among the plurality of ion species is synchronized with a predetermined timing in repetition of the sample collecting operation and the ionization operation by the ion source.

According to the present invention, the mass spectrometric unit may be, for example, besides a single type quadrupole mass spectrometer, a mass spectrometer capable of performing an MS/MS analysis such as a triple quadrupole mass spectrometer, a quadrupole Time-of-Flight type (Q-TOF type) mass spectrometer, or the like. When the mass spectrometric unit is a single type quadrupole mass spectrometer, the above-mentioned "mass spectrometry targeting a plurality of ion species" is SIM measurement for a plurality of ion species having different mass-to-charge ratios. When the mass spectrometric unit is a mass spectrometer capable of performing MS/MS analysis, the above-mentioned "mass spectrometry targeting a plurality of ion species" is MRM measurement for different MRM transitions (a combination of the mass-to-charge ratio of a precursor ion and the mass-to-charge ratio of a product ion).

With the PESI mass spectrometer of a first aspect of the present invention, the synchronization control unit may be configured to control the ionization control unit and/or the mass spectrometry control unit such that a timing of executing mass spectrometry targeting one preset specific ion species is synchronized with a predetermined timing in a series of sample collecting operation and ionization operation by the ion source over a plurality of times of repetition of the sample collecting operation and the ionization operation.

With the PESI mass spectrometer of a second aspect of the present invention, the synchronization control unit may be configured to control the ionization control unit and/or the mass spectrometry control unit so as to change an ion species among a plurality of preset ion species for which a predetermined timing in repetition of sample collecting operation and ionization operation by the ion source is synchronized with a timing of executing mass spectrometry every time a series of sample collecting operation and ionization operation by the ion source is performed once or a plurality of times.

With the PESI mass spectrometer of the first aspect, for example, a plurality of ion species that are targets of mass spectrometry, specifically, a mass-to-charge ratio and MRM transitions of an SIM measurement target, and an ion species for which the timing of mass spectrometry is to be synchronized with the timing of sample collection/ionization operation are preset by a user. When the mass spectrometric control unit controls the mass spectrometric unit under these settings to sequentially execute mass spectrometry targeting a plurality of set ion species. In this case, the synchronization control unit controls one or both of the ionization control unit and the mass spectrometry control unit to synchronize the timing of executing mass spectrometry targeting a specific set ion species with a predetermined timing in repetition of sample collection/ionization operation by the ion source.

The "predetermined timing in repetition of sample collection/ionization operation by the ion source" may be typically the timing at which the generation of ions derived from a sample component is started, that is, the point of time when the high voltage application to the probe is started, but is not limited to the above. Any point of time in the cycle of the sample collection/ionization operation is possible. For example, when the synchronization control unit controls the operation of the ionization control unit and the mass spectrometry control unit to match the point of time when the high voltage is applied to the probe from the high voltage generation unit with the timing of executing the mass spectrometry targeting the specific ion species, the mass spectrometry on the specific ion species is executed in a state where the rate of generated ions derived from a sample component is reliably high. Therefore, it is possible to analyze the specific ion species with high sensitivity.

With the PESI mass spectrometer of the second aspect, the synchronization control unit controls the operations of the ionization control unit and the mass spectrometry control unit such that, for example, the timing of mass spectrometry targeting, not a fixed specific ion species, but an ion species that is different every time the sample is collected at the tip of the probe matches the timing of start of the high voltage application to the probe. Thus, the ion species to be analyzed with high sensitivity are changed every time the sample is collected. Therefore, the ion species to be analyzed with high sensitivity is not unevenly limited to one specific ion species, making it possible to perform analysis with high sensitivity on average for all of a plurality of set ion species.

The PESI mass spectrometer according to the present invention preferably further includes a synchronization condition setting unit configured to allow a user to set an ion species among a plurality of ion species targeted for mass spectrometry by the mass spectrometric unit for which a predetermined timing in repetition of the sample collecting operation and the ionization operation by the ion source is to be synchronized with a mass spectrometric operation.

The synchronization condition setting unit may be a means for displaying an input setting screen in a predetermined format on the screen of the display unit and accepting information set by the user performing an input manipulation or a selection manipulation on the input setting screen.

With this configuration, the user can preset an ion species derived from a component to be analyzed with high sensitivity in the mass-to-charge ratio and the MRM transition of a plurality of SIM measurement targets. Thus, because the timing of the mass spectrometry for the ion species set by the user is synchronized with the timing of the sample collection/ionization operation, the ion species derived from the component desired by the user can be analyzed with high sensitivity.

In the above configuration, the synchronization condition setting unit is preferred to be capable of selecting a mode in which an ion species for which a predetermined timing in repetition of the sample collecting operation and the ionization operation by the ion source is synchronized with a mass spectrometric operation is changed with lapse of time.

With this configuration, when the user selects the mode, as described above, the ion species to be analyzed with high sensitivity can be changed every one or a plurality of times of sample collection. Thus, analysis can be performed with high sensitivity on average for all of the plurality of set ion species.

As described above, substantially no ions derived from the sample component are generated during the sample collecting operation, that is, during the period when the high voltage is not applied to the probe. Therefore, according to the present invention, the synchronization control unit may control the mass spectrometric unit to pause the mass spectrometric operation with the mass spectrometric unit during a period in which a voltage is not applied to the probe from the high voltage generation unit. That is, the pause period may be incorporated in one cycle in which the mass spectrometry is performed on a plurality of ion species.

Advantageous Effects of Invention

The PESI mass spectrometer according to the present invention is capable of, when the SIM measurement or MRM measurement is performed on a plurality of ion species, analyzing specific ion species with high sensitivity or analyzing all ion species with the same average degree of sensitivity. Thus, for example, it is possible to reliably quantify a specific component with higher accuracy than other components, or to quantify all of a plurality of components with high accuracy on average.

DESCRIPTION OF EMBODIMENTS

Figure 1:
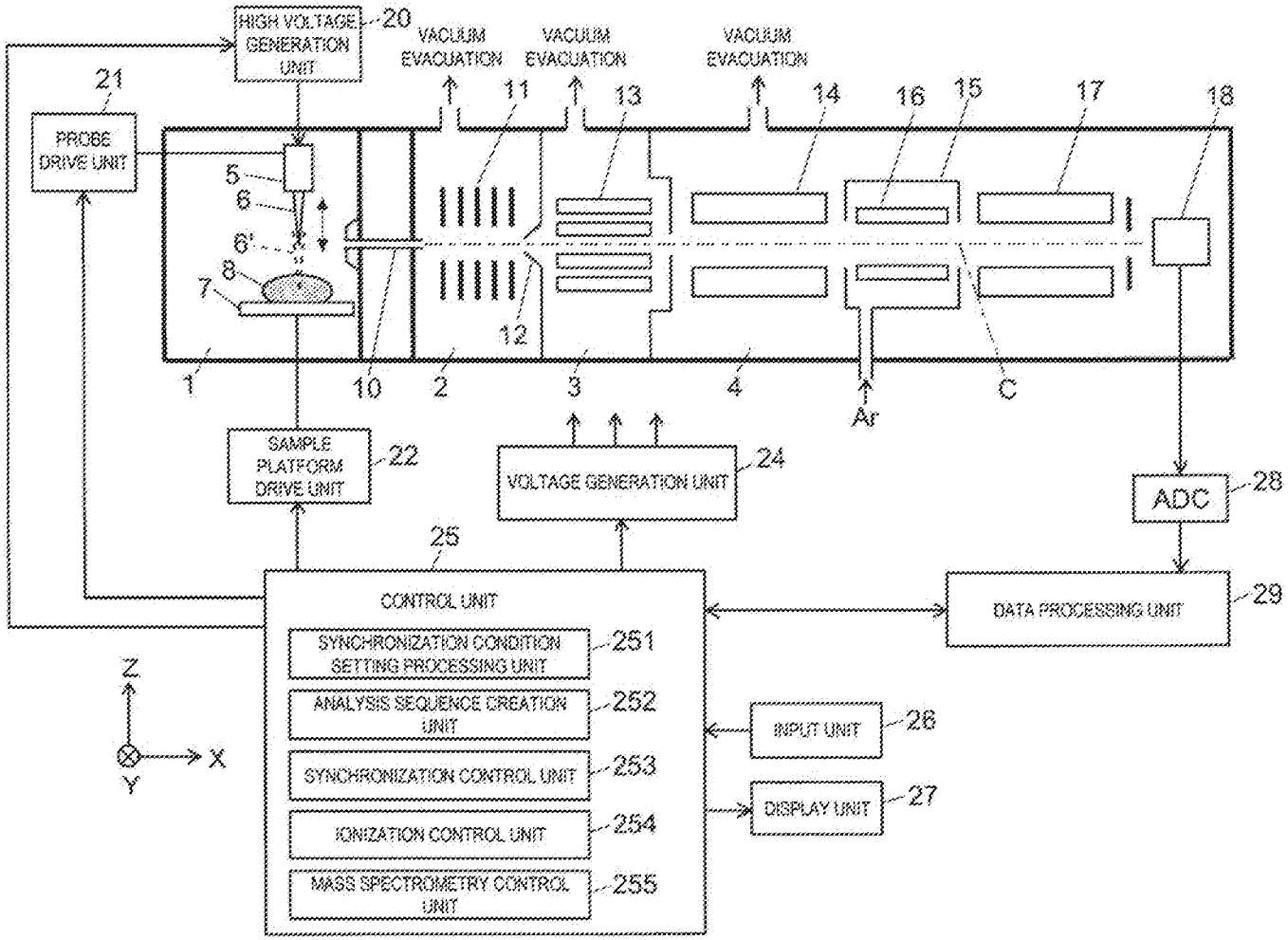
FIG. 1 is a schematic configuration diagram of an embodiment of a PESI mass spectrometer according to the present invention.

An embodiment of the PESI mass spectrometer according to the present invention will be described with reference to the accompanying drawings. FIG. 1 is a schematic configuration diagram of the PESI mass spectrometer of the present embodiment.

This PESI mass spectrometer includes, as shown in FIG. 1, a configuration of a multi-stage differential evacuation system including a plurality (two in this example) of intermediate vacuum chambers 2, 3 in which the degree of vacuum is gradually increased between an ionization chamber 1 for ionizing components contained in a sample in an atmospheric pressure atmosphere and an analysis chamber 4 for mass separation and detection of ions in a high vacuum atmosphere.

A sample 8 to be measured is placed on a sample platform 7 arranged in the ionization chamber 1 having a substantially atmospheric pressure atmosphere. A metallic probe 6 held by a probe holder 5 is arranged above the sample 8 so as to extend in an up-and-down direction (Z-axis direction). The probe holder 5 can be moved in the up-and-down direction (Z-axis direction) by a probe drive unit 21 including a motor, a speed reduction mechanism, or the like. Further, the sample platform 7 can be moved in two axial directions: an X axis and a Y axis, by a sample platform drive unit 23. Further, a direct-current high voltage of about several kV at maximum is applied to the probe 6 from a high voltage generation unit 20.

The inside of the ionization chamber 1 and the inside of the first intermediate vacuum chamber 2 are communicated with each other through a small-diameter capillary tube 10, and a gas in the ionization chamber 1 is drawn into the first intermediate vacuum chamber 2 via the capillary tube 10 due to a pressure difference between the openings at both ends of the capillary tube 10. Inside the first intermediate vacuum chamber 2, an ion guide 11 including a plurality of electrode plates arranged along an ion optical axis C and around the ion optical axis C is provided. Further, the inside of the first intermediate vacuum chamber 2 and the inside of the second intermediate vacuum chamber 3 are communicated with each other through a small hole formed at the top of a skimmer 12. In the second intermediate vacuum chamber 3, an octapole type ion guide 13 in which eight rod electrodes are arranged around the ion optical axis C is installed. In the analysis chamber 4, a front quadrupole mass filter 14 in which four rod electrodes are arranged around the ion optical axis C, a collision cell 15 in which an ion guide 16 is arranged, a back quadrupole mass filter 17 having the same electrode structure as the front quadrupole mass filter 14, and an ion detector 18 are installed.

A collision gas such as argon or helium is continuously or intermittently introduced into the collision cell 15 from the outside. Further, one of a direct current voltage, a high frequency voltage, or the voltage obtained by superimposing a high frequency voltage on a direct current voltage is applied from a voltage generation unit 24 to the ion guides 11, 13, 16, the quadrupole mass filters 14, 17, the ion detector 18, and the like.

A detection signal from the ion detector 18 is digitized by an analog-digital converter (ADC) 28 and is input to a data processing unit 29. A control unit 25 controls the high voltage generation unit 20, the probe drive unit 21, the sample platform drive unit 23, the voltage generation unit 24, and the like to perform analysis on the sample 8, and includes functional blocks such as a synchronization condition setting processing unit 251, an analysis sequence creation unit 252, a synchronization control unit 253, an ionization control unit 254, and a mass spectrometry control unit 255. Further, an input unit 26 and a display unit 27 as a user interface are connected to the control unit 25.

First, an operation when performing mass spectrometry on the sample 8 in the PESI mass spectrometer of the present embodiment will be schematically described.

The sample 8 is assumed to be a biological sample such as a living tissue section. When the probe drive unit 21 moves the probe 6 down to a predetermined position (the position indicated by the dotted line 6' in FIG. 1) in response to an instruction from the control unit 25, the tip of the probe 6 pierces the sample 8, and a small amount of the sample is adhered to the tip of the probe 6. Then, when the probe 6 is pulled up to a predetermined analysis position (the position indicated by the solid line 6 in FIG. 1), the high voltage generation unit 20 applies a high voltage to the probe 6. As a result, the electric field is concentrated on the tip of the probe 6, and the components in the sample adhered to the tip of the probe 6 are ionized by the electrospray phenomenon.

The generated ions are sucked into the capillary tube 10 due to the pressure difference, and are sequentially transported to the first intermediate vacuum chamber 2, the second intermediate vacuum chamber 3, and the analysis chamber 4 by the action of the electric fields formed by the ion guides 11 and 13. In the analysis chamber 4, the ions are introduced into the front quadrupole mass filter 14, and only ions (precursor ions) having the mass-to-charge ratio according to the voltage applied to the rod electrode of the quadrupole mass filter 14 pass through the quadrupole mass filter 14 and are introduced into the collision cell 15. A collision gas is introduced into the collision cell 15, and the ions collide with the collision gas in the collision cell 15 and are cleaved by collision-induced dissociation (CID). Various product ions generated by cleavage leave the collision cell 15 and are introduced into the back quadrupole mass filter 17, and only product ions having the mass-to-charge ratio according to the voltage applied to the rod electrode of the quadrupole mass filter 17 pass through the back quadrupole mass filter 17 and reach the ion detector 18. The ion detector 18 generates an ionic strength signal according to the amount of ions that have reached.

For example, the application of voltage to the rod electrode of the quadrupole mass filter 14 is set so that only ions having a specific mass-to-charge ratio pass through the front quadrupole mass filter 14, and simultaneously, the application of voltage to the rod electrode of the quadrupole mass filter 17 is set so that only product ions having a specific mass-to-charge ratio pass through the back quadrupole mass filter 17. Thus, it is possible to acquire an ionic strength signal of product ions having a specific mass-to-charge ratio generated by dissociation of specific precursor ions. This is the MRM measurement.

As described above, in the PESI mass spectrometer of the present embodiment, the probe 6 is moved back and forth once to adhere the sample to the tip of the probe 6, and then a high voltage is applied to the probe 6 to ionize the components in the sample collected by the probe 6. Since the amount of the sample adhered to the probe 6 is extremely small, the components are depleted as the ionization progresses, and the ions are not generated. Therefore, as already described with reference to FIG. 6, the ionic strength decreases with lapse of time from the point of time of the start of high voltage application. Since the ionic strength in the PESI ion source is largely time-dependent, the next sample collection and ionization (application of high voltage to the probe 6) is preferably performed while the time during which a certain level of ionic strength is obtained (ion generation duration) elapses.

Figure 2:
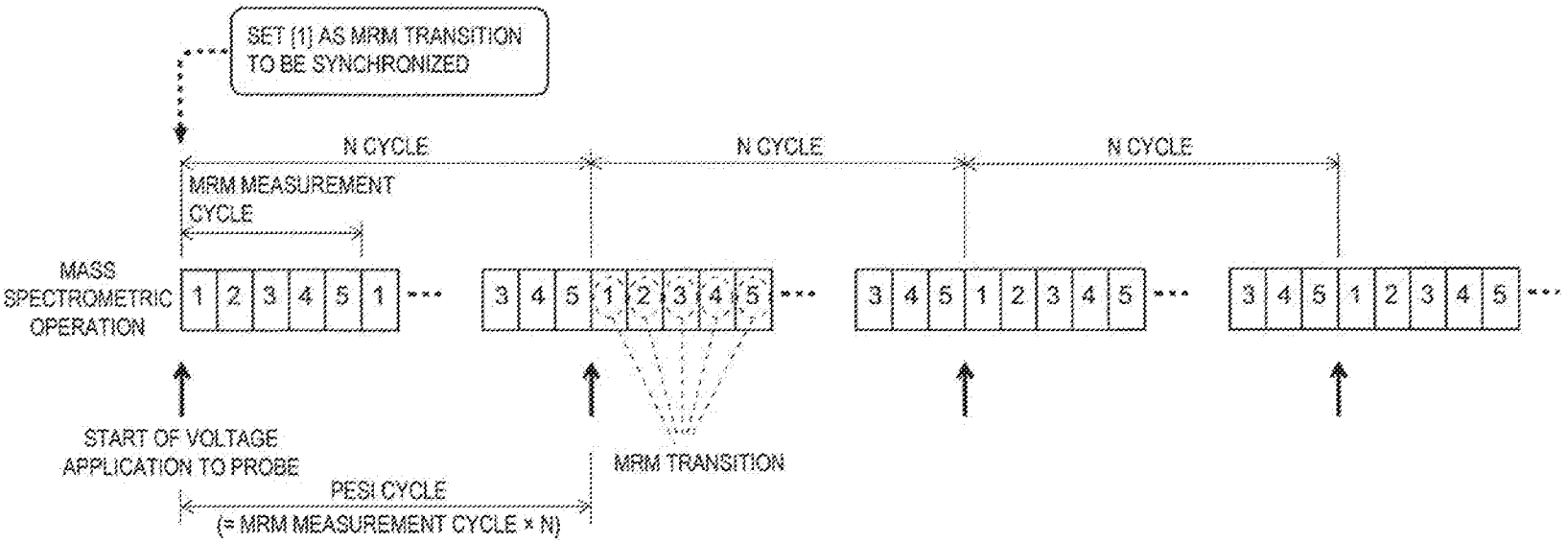
FIG. 2 is an explanatory diagram of an example of the timings of an operation of an ion source and an operation of a mass spectrometric unit in a PESI mass spectrometer of the present embodiment.
Figure 3:
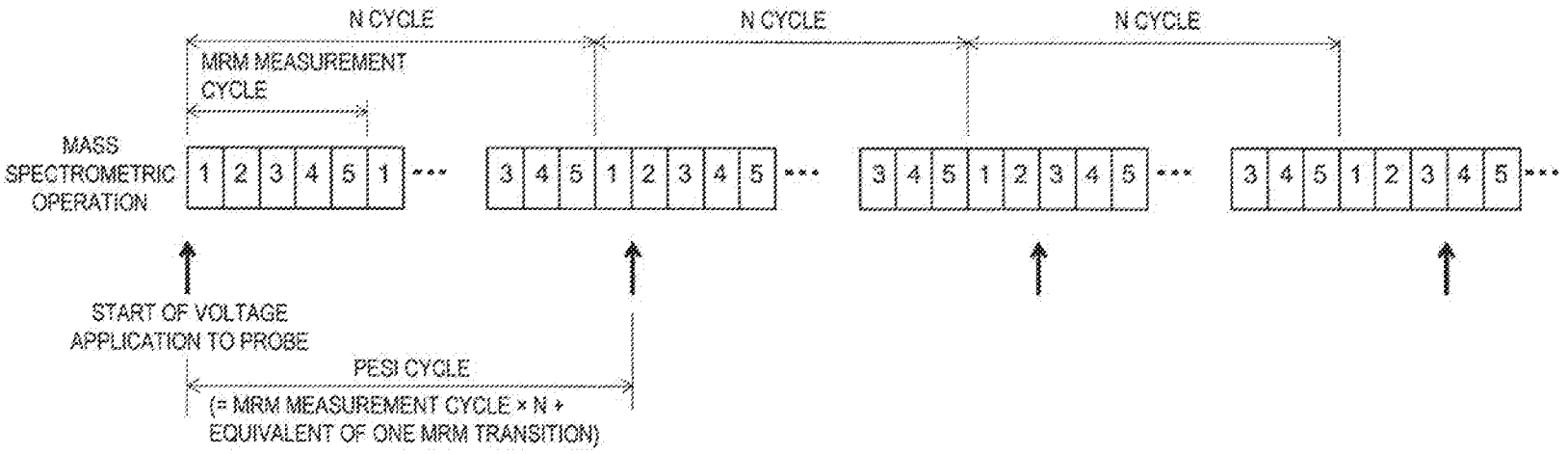
FIG. 3 is an explanatory diagram of another example of the timings of an operation of an ion source and an operation of a mass spectrometric unit in a PESI mass spectrometer of the present embodiment.
Figure 4:
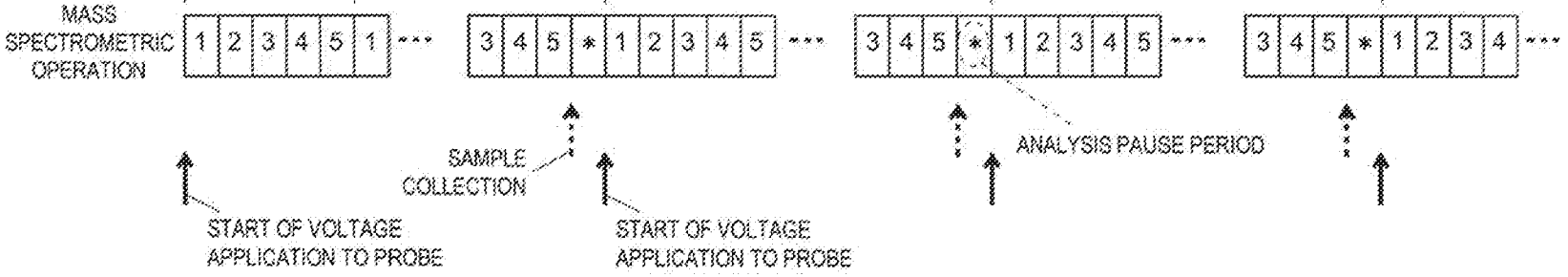
FIG. 4 is an explanatory diagram of yet another example of the timings of an operation of an ion source and an operation of a mass spectrometric unit in a PESI mass spectrometer of the present embodiment.
Figure 5:
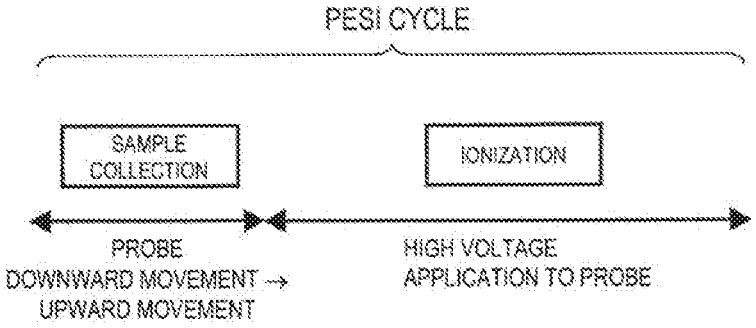
FIG. 5 is an explanatory diagram of an operation performed in one cycle of a PESI ion source.

When performing MRM measurement for a plurality of components, temporal fluctuations in the ionic strength are unavoidable during that time, and ions are not generated while moving the probe 6 and collecting the sample at the tip of the probe 6. Therefore, in order to reduce the influence of such temporal fluctuations in ionic strength, the PESI mass spectrometer of the present embodiment carries out the following characteristic control during analysis. This will be described with reference to FIGS. 2 to 4. FIGS. 2 to 4 are explanatory diagrams of the timings of the operation of the PESI ion source and the operation of the mass spectrometric unit.

When the user performs a predetermined manipulation on the input unit 26, the analysis sequence creation unit 252 displays, on the screen of the display unit 27, a screen for inputting analysis conditions such as MRM transitions to be measured. When the user inputs a predetermined analysis condition such as MRM transitions on this screen, the analysis sequence creation unit 252 creates an analysis sequence according to the input analysis condition and stores it internally. Here, the analysis sequence is assumed to repeat the MRM measurement cycle for a predetermined time in which the MRM measurement is executed once for each of five types of MRM transitions. In FIGS. 2 to 4, these five types of MRM transitions are indicated by numbers 1 to 5. Further, in the following description, the MRM transitions indicated simply by numbers in FIGS. 2 to 4 are described as [1], . . . , [5].

The synchronization condition setting processing unit 251 causes the user to select an MRM transition from among the five types of MRM transitions that have been input and set, for which the mass spectrometric operation is to be synchronized with the operation timing of the PESI ion source. In addition to the measurement mode that synchronizes the MRM measurement for a specific MRM transition with the operation timing of the PESI ion source, the measurement mode that decentralizes the MRM transitions to be synchronized with the operation of the ion source so as to prevent one MRM transition from being selected unevenly (hereinafter referred to as "quantitative accuracy averaging measurement mode") is also provided, and the user can also select this measurement mode.

As an example, it is assumed that the MRM transition corresponding to the component to be analyzed with the highest sensitivity among the five types of MRM transitions is MRM transition [1]. In this case, the user selects and instructs the MRM transition [1] as the MRM transition to be synchronized with the operation timing of the ion source.

As described above, the analysis sequence creation unit 252 creates an analysis sequence that executes an MRM measurement cycle in which the MRM measurement is executed once for each of the five types of MRM transitions [1] to [5]. The data acquisition time in MRM measurement for one MRM transition, that is, the dwell time, is defined as one of the analysis conditions by default or by user setting. Therefore, the loop time that is the MRM measurement cycle execution time is determined, and the length of time for repeating the MRM measurement cycle N times (N is an integer of 1 or more) is also determined when N is determined. As described above, when the dwell time and the value of N are determined so that the execution time of N MRM measurement cycles is equal to or less than the ion generation duration, a certain level of ionic strength can be obtained in any MRM measurement. However, the sensitivity of the MRM measurement on the MRM transition [1] is not always the maximum.

In the PESI mass spectrometer of the present embodiment, the synchronization control unit 253 determines, from the loop time determined from the dwell time and the preset ion generation duration, the time required for the PESI cycle to be less than or equal to the ion generation duration and the number of times of repetition N of the MRM measurement cycle corresponding to the time. For example, when the loop time is 40 msec and the ion generation duration is 100 msec, it is sufficient if the PESI cycle time is set to 80 msec and the number of times of repetition N of the MRM measurement cycle is set to 2. Then, as shown in FIG. 2, the operations of the ionization control unit 254 and the mass spectrometry control unit 255 are controlled such that the timing of starting the application of the high voltage to the probe 6 after the sample is collected at the tip of the probe 6 (the timing indicated by the upward arrow in FIG. 2) becomes immediately before the MRM measurement for the MRM transition [1] that is firstly performed in the MRM measurement cycle.

For example, the ionization control unit 254 may control each unit to repeatedly perform the sample collecting operation and the ionization operation with a PESI cycle time of 80 msec, and the synchronization control unit 253 may control the mass spectrometry control unit 255 such that the timing of starting the high voltage application during each PESI cycle is synchronized with the timing of starting the MRM measurement with respect to the MRM transition [1] in the MRM measurement cycle. On the contrary, the mass spectrometry control unit 255 may control each unit to repeatedly perform the MRM measurement cycle having a loop time of 40 msec, and the synchronization control unit 253 may control the ionization control unit 254 such that the timing of starting the MRM measurement with respect to the MRM transition [1] in each MRM measurement cycle is synchronized with the timing of starting high voltage application to the probe 6.

Figure 6:
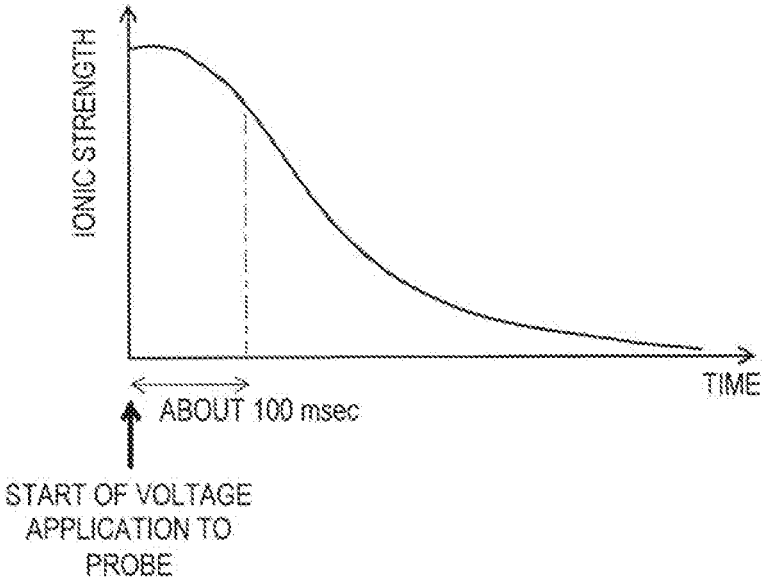
FIG. 6 is a schematic diagram showing an example of ionic strength changes with lapse of time from the point of time of the start of voltage application to a probe.

As shown in FIG. 6, generally, ions are actively generated for a little while from the point of time when a high voltage is applied to the probe 6 to which the sample is adhered, and then the rate of generated ions gradually decreases. Therefore, the sensitivity becomes the highest in the MRM measurement of the MRM transition [1] that is performed firstly in each MRM measurement cycle. The data processing unit 29 creates a mass chromatogram based on the ionic strength data obtained for different MRM transitions, and determines a quantitative value of a target component based on the area value of the peak observed on the mass chromatogram. As for the target component corresponding to the MRM transition [1], which can be detected with high sensitivity, the mass chromatogram of such component is more accurate than that of other components, and thus high quantitativeness can be achieved.

When the MRM transition of the component to be analyzed with the highest sensitivity among the 5 types of MRM transitions is the MRM transition [3], it is sufficient if the user selects and instructs the MRM transition [3] as an MRM transition to be synchronized with the timing of the operation of the ion source before executing the analysis. In that case, the control operations of the ionization control unit 254 and the mass spectrometry control unit 255 are controlled such that the timing of starting the application of the high voltage to the probe 6 after the sample is collected at the tip of the probe 6 becomes immediately before the MRM measurement for the MRM transition [3] that is thirdly performed in the MRM measurement cycle.

Next, the control operation when the quantitative accuracy averaging measurement mode is selected by the user will be described with reference to FIG. 3.

In this case, the analysis sequence creation unit 252 creates an analysis sequence that repeats the MRM measurement cycle in which the MRM measurement is executed once for each of the five types of MRM transitions [1] to [5], as in the above case. Then, the mass spectrometry control unit 255 controls each unit so as to repeat the MRM measurement according to the created analysis sequence. The synchronization control unit 253 controls the operation of the ionization control unit 254 such that the timing of starting the application of the high voltage to the probe 6 after the sample is collected at the tip of the probe 6 is shifted for the MRM measurement on one MRM transition with respect to each of N MRM measurement cycles. As a result, as shown in FIG. 3, in a PESI cycle next to the PESI cycle in which the high voltage application to the probe 6 is started immediately before the start of the MRM measurement of the MRM transition [1], the high voltage application to the probe 6 starts immediately before the start of execution of the MRM measurement of the MRM transition [2].

In the case of the quantitative accuracy averaging measurement mode, one MRM transition for the MRM measurement performed during the period when the most amount of ions are generated is not selected unevenly, and the MRM measurement for all MRM transitions is sequentially performed with high sensitivity. This makes it possible to perform an analysis with high sensitivity on average for all MRM transitions instead of a specific MRM transition.

In the examples shown in FIGS. 2 and 3, since the MRM measurement is performed even during the sample collecting period during which substantially no ions are generated, the ionic strength decreases in the MRM measurement. Therefore, as shown in FIG. 4, an analysis pause period having the same length as the sample collecting period in the PESI ion source may be provided in advance in the N MRM measurement cycles, and the synchronization control unit 253 may control each unit such that this analysis pause period comes in the sample collecting period in the PESI ion source. As a result, the MRM measurement is not performed during the sample collecting period during which substantially no ions are generated, and fluctuations in sensitivity for all MRM transitions can be further reduced.

Although the mass spectrometric unit is a triple quadrupole mass spectrometer in the above embodiment, the mass spectrometric unit may be a Q-TOF mass spectrometer. Further, it may not be a mass spectrometer capable of performing MS/MS analysis, and may be, for example, a single type quadrupole mass spectrometer.

The above-mentioned embodiment is an example of the present invention, and it is obvious that any variation, modification, or addition appropriately made within the scope of the gist of the present invention is also included in the scope of the claims of the present application.

REFERENCE SIGNS LIST

1 . . . Ionization Chamber
2, 3 . . . Intermediate Vacuum Chamber
4 . . . Analysis Chamber
5 . . . Probe Holder
6 . . . Probe
7 . . . Sample Platform
8 . . . Sample
10 . . . Capillary Tube
11, 13, 16 . . . Ion Guide
12 . . . Skimmer
14 . . . Front Quadrupole Mass Filter
15 . . . Collision Cell
17 . . . Back Quadrupole Mass Filter
18 . . . Ion Detector
20 . . . High Voltage Generation Unit
21 . . . Probe Drive Unit
23 . . . Sample Platform Drive Unit
24 . . . Voltage Generation Unit
25 . . . Control Unit
251 . . . Synchronization Condition Setting Processing Unit
252 . . . Analysis Sequence Creation Unit
253 . . . Synchronization Control Unit
254 . . . Ionization Control Unit
255 . . . Mass Spectrometry Control Unit
26 . . . Input Unit
27 . . . Display Unit
29 . . . Data Processing Unit
C . . . Ion Optical Axis

The invention claimed is:

1. A probe electrospray ionization mass spectrometer comprising:

an ion source including:

a sample platform on which a sample is placed, the sample platform being movable;

a probe having conductivity, the probe being movable and having a tip configured to receive the sample; and a power generator configured to apply a high voltage to the probe to ionize a component in the sample provided on the probe, the probe electrospray ionization mass spectrometer being configured to perform mass spectrometry on an ion generated by the ion source or an ion derived from the ion, and further comprising:

a controller configured to:

control the power generator and at least one of the probe and the sample platform to repeat a probe electrospray ionization (PESI) cycle including a sample collecting operation and an ionization operation at a predetermined frequency, the sample collection operation comprising moving the probe or the sample platform to adhere the sample to the tip of the probe and then removing the tip of the probe from the sample, and the ionization operation comprising applying the high voltage to the probe from the power generator to ionize a sample component;

repeat a cycle of sequentially executing mass spectrometry targeting a plurality of ion species; and control a timing of executing mass spectrometry targeting an ion species preset by a user among the plurality of ion species to be synchronized with a predetermined timing in the PESI cycle.

2. The probe electrospray ionization mass spectrometer according to claim 1, wherein the ion species preset by the user is one specific ion species.

3. The probe electrospray ionization mass spectrometer according to claim 1, wherein the ion species preset by the user is changed every time the PESI cycle is performed once or a plurality of times.

4. The probe electrospray ionization mass spectrometer according to claim 1, wherein the controller is further configured to:

receive, as the ion species preset by the user, a user selection of an ion species among the plurality of ion species.

5. The probe electrospray ionization mass spectrometer according to claim 1, wherein the controller is further configured to allow the user to select a mode in which the ion species preset by the user is changed based on lapse of time.

6. The probe electrospray ionization mass spectrometer according to claim 1, wherein the predetermined timing includes a point in time when the high voltage is applied to the probe.

7. The probe electrospray ionization mass spectrometer according to claim 6, wherein the controller is further configured to pause a mass spectrometric operation during a period in which a voltage is not applied from the power generator to the probe.

8. The probe electrospray ionization mass spectrometer according to claim 2, wherein the predetermined timing includes a point in time when the high voltage is applied to the probe.

9. The probe electrospray ionization mass spectrometer according to claim 3, wherein the predetermined timing includes a point in time when the high voltage is applied to the probe.

10. The probe electrospray ionization mass spectrometer according to claim 8, wherein the controller is further configured to pause a mass spectrometric operation during a period in which a voltage is not applied from the power generator to the probe.

11. The probe electrospray ionization mass spectrometer according to claim 9, wherein the controller is further configured to pause a mass spectrometric operation during a period in which a voltage is not applied from the power generator to the probe.

* * * * *